US005966886A

United States Patent [19]

Di Loreto

[11] Patent Number: 5,966,886

[45] Date of Patent: Oct. 19, 1999

[54] METHOD FOR PARTIALLY BUILDING AND/OR REPAIRING AT HIGH TEMPERATURES INDUSTRIAL FACILITIES INCLUDING A STRUCTURE MADE OF REFRACTORY MATERIALS, AND PREFABRICATED ELEMENT THEREFOR

[75] Inventor: Oswaldo Di Loreto, Boussu, Belgium

[73] Assignee: FIB-Services, Boussu, Belgium

[21] Appl. No.: 09/089,482

[22] Filed: Jun. 2, 1998

Related U.S. Application Data

[62] Division of application No. 08/700,357, filed as application No. PCT/BE95/00010, Feb. 3, 1995.

[30] Foreign Application Priority Data

Feb. 25, 1994 [BE] Belgium ..... 9400219

[51] Int. Cl.[6] ..... E04B 2/00

[52] U.S. Cl. ..... 52/506.02; 52/506.01; 52/510; 52/747.13; 52/218; 52/514.5

[58] Field of Search ..... 52/506.02, 506.01, 52/510, 267, 265, 747.13, 218, 514.5

[56] References Cited

U.S. PATENT DOCUMENTS

| | | | |
|---|---|---|---|
| 1,328,380 | 1/1920 | Laird | 52/267 |
| 1,806,113 | 5/1931 | Nygaard | 52/510 |
| 1,884,524 | 10/1932 | Baumgartner | 52/510 |
| 2,330,129 | 9/1943 | Lucas et al. . | |
| 2,476,305 | 7/1949 | Kimmel | 52/747.13 |
| 4,452,749 | 6/1984 | Kolvek et al. . | |
| 4,489,022 | 12/1984 | Robyn et al. . | |
| 4,542,888 | 9/1985 | Robyn et al. . | |
| 4,571,318 | 2/1986 | Dudro, Jr. et al. . | |
| 4,835,831 | 6/1989 | Melton | 52/506.02 |
| 5,002,910 | 3/1991 | Robyn . | |
| 5,316,268 | 5/1994 | Mantey . | |
| 5,833,895 | 11/1998 | Di Loreta | 264/30 |

FOREIGN PATENT DOCUMENTS

| | | |
|---|---|---|
| 0 577 735 | of 0000 | European Pat. Off. . |
| 1 292 156 | 11/1972 | United Kingdom . |

*Primary Examiner*—Carl D. Friedman
*Assistant Examiner*—Dennis L. Dorsey
*Attorney, Agent, or Firm*—Browdy and Neimark

[57] ABSTRACT

A method for repairing industrial facilities at high temperatures using at least one prefabricated element (1) made of mullite-crystallized refractory product with an alumina content of 30–80%, preferably 50–80%, made of refractory materials securely attached to the structure (11) of the facility by using an oxygen-containing carrier gas stream to spray a mixture of particles capable of exothermically reacting with the oxygen and particles of a refractory material, whereby a coherent refractory mass (14) is formed in situ for attaching said element to said structure.

19 Claims, 2 Drawing Sheets

METHOD FOR PARTIALLY BUILDING AND/OR REPAIRING AT HIGH TEMPERATURES INDUSTRIAL FACILITIES INCLUDING A STRUCTURE MADE OF REFRACTORY MATERIALS, AND PREFABRICATED ELEMENT THEREFOR

CROSS-REFERENCE TO RELATED APPLICATIONS

This is a division of copending parent application Ser. No. 08/700,357 filed Aug. 23, 1996, which is a 371 of PCT/BE95/00010 Feb. 3, 1995.

FIELD OF INVENTION

The present invention concerns a method for partially building and/or repairing at high temperatures industrial facilities comprising a structure made of refractory materials, particularly facilities operating by indirect heating with the aid of flues, such as batteries of coke ovens, according to which use is made of at least one prefabricated element made of refractory materials which is securely attached to said structure by reactive spraying, in an oxygen-containing carrier gas stream, a mixture of particles of a preferably inert refractory material.

BACKGROUND OF THE INVENTION

Since in industrial facilities, as defined above, structures made of refractory materials, which are generally siliceous in nature and made of silica, must always be kept at a temperature above 300° C. in order to prevent their weakening by polymorphic transformation, repair methods at high temperature have long been suggested for their repair. These methods may also be used for partial constructions of such facilities, in particular to modify an existing structure by adding a wall or a burned gas discharge pipe, for example.

Thus, bricks made of vitreous silica, which are characterized by a very low expansion coefficient, have been developed and employed conventionally in order to perform such repairs at high temperature. However, it was found that these repairs were not gas-tight, particularly in the case of batteries of coke ovens.

French patent FR 2541440-Bl (Glaverbel), corresponding to U.S. Pat. No. 4,542,888 (Robyn et al), describes a method of repair at high temperatures using vitreous silica bricks of this kind and a ceramic welding method for producing the new masonry joints and also full recharging of the structure (GB 1.330.894 and GB 2.110.200 A by Glaverbel). With this method, the vitreous silica is bricks preferably comprise a chamfer to facilitate making of the joints.

In another patent using the same ceramic welding method (DE 3643420 A1, Fosbel Europe), the full-thickness repair bricks are paired and then brought to the service temperature prior to filling the space between the old and the new masonry by ceramic welding without, however, fully recharging the zone repaired by ceramic welding.

Generally speaking, although vitreous silica bricks, when they are brought to a high temperature, start upon a slow process of crystallization (into cristobalite and tridymite), they nonetheless keep their sensitivity to creep when they are subjected to a high-temperature charge.

This effect is observed in coke ovens where repairs of this type in the vicinity of the flues show well-known sagging after being in the service for some time.

SUMMARY OF THE INVENTION

One of the essential aims of the present invention is to provide a new method for overcoming the aforementioned drawbacks, which jeopardize the reliability of this type of partial building or repair, and to do this in a relatively simple and economically sound manner.

To this end, according to the invention, use is made of a prefabricated element and a mullite-crystallized refractory product with an alumina content of 30–85%, preferably 50–80% alumina, and a mixture of particles capable of reacting exothermically with the oxygen and particles of a refractory material, the composition of which is such as to form in situ a refractory mass which is compatible with the composition of the aforementioned element and structure and which has a thermal expansion coefficient compatible with the coefficient of thermal expansion of the aforementioned element and structure to which said mass must be attached, with account being taken of the stresses to which the latter will be subjected under working conditions.

Advantageously, accordingly to the invention, for the abovementioned spraying, use is made, as particles being capable of reacting exothermically with oxygen, of at least one of the products in the group formed by the following metals: Al, Si, Mg, Ca, Fe, Cr, Zr, Sr, Ba and Ti, and by compounds of these metals capable, by decomposition, of forming, with oxides from these metals, mixed oxides in such a way as to constitute a bonding phase for the aforementioned particles made of refractory material.

According to one specific embodiment of the invention, in the case of facilities comprising heat treatment chambers heated with the aid of flues, the aforementioned prefabricated element is placed on the side of the flues and the aforementioned coherent refractory mass is applied on the side of the heat treatment chamber.

The invention concerns also a prefabricated element for the repairing or the partial construction at high temperatures of industrial facilities comprising a structure made of refractory materials, particularly facilities operating by indirect heating with the aid of flues, such as batteries of coke ovens, which element is namely appropriate to be used in the aforementioned method.

This prefabricated element is characterized by the fact that it is based on a mullite-crystallized refractory product with an alumina content comprised between 30 and 85% and preferably between 50 and 80% alumina and which has, preferably, a rectangular prismatic form of which one of the faces is provided with means for obtaining mechanical bonding with a coherent refractory mass formed by reactive spraying on this face.

Other details and features of the invention will be apparent from the description given below, by way of non-limitative example, with reference to the attached drawings, of several specific embodiments of the method according to the invention and of a prefabricated element enabling this method to be used.

BRIEF DESCRIPTION OF THE DRAWINGS

In these figures, the same reference numbers relate to analogous or identical elements.

DETAILED DESCRIPTION OF THE INVENTION

Figure 1:
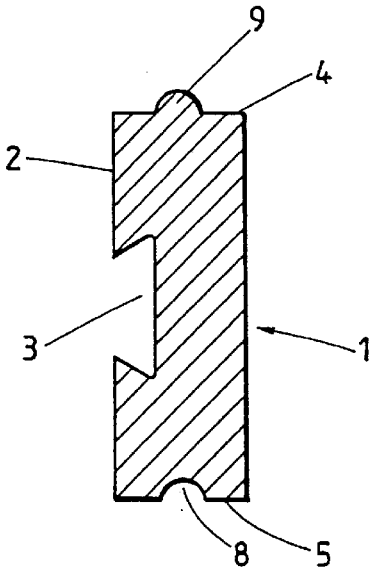
FIG. 1 is a cross-section along line I—I of FIG. 2, of a prefabricated element according to a preferred embodiment of the invention.

The present invention thus concerns both the repair at high temperatures of industrial facilities comprising a structure made of refractory materials and the reconstruction at high temperatures of a part of such industrial facilities and modifications at high temperatures of the latter.

More specifically, the method according to the invention is based on the dissociation of the stresses encountered at the level of the heat-exchange wall of a structure made of refractory materials of an industrial facility. Thus, according to the invention, consideration is given to the stresses acting on said wall on the heating side where, for example, the flues are located, and also on the opposite side of said wall where the heat treatment chamber is located.

The invention is thus applicable in all industrial facilities where a situation of this kind arises.

However, given that coke ovens constitute industrial facilities in respect of which repairs to the heat-exchange walls must be regularly performed, the description given below will be confined to this particular application.

In order to physically achieve the aforementioned dissociation, use is made, at the point where repair of the wall in question is to take place, of two distinct materials which are joined in such a way as to form a "twin-layer" panel at this point. Thus, on the flue side, use is made of a refractory product which is well suited to the stresses encountered at this point. On the other hand, on the heat treatment chamber side, a refractory lining is to be formed which is well suited to the stresses which are peculiar to it.

According to the invention, use is made, on the flue side, of the prefabricated elements made of a mullite-crystallized refractory product with an alumina content of 30–85%, preferably 50–80% alumina (with the remainder being essentially formed of silica), which is securely attached to the wall to be repaired on the heat treatment chamber side by using an oxygen-containing carrier gas stream to spray a mixture of exothermically oxidizable particles and of particles of a refractory material. The composition of said mixture is chosen in such a way as to form in situ a refractory mass which is compatible with the composition and the coefficient of thermal expansion of both the element and the original masonry, with account being taken of the stresses to which said mass will be subjected under working conditions.

It has been found that said prefabricated element has the advantage of exhibiting good resistance to thermal shocks while at the same time guaranteeing high refractoriness, mechanical strength and creep resistance over a wide range of temperatures.

In addition, in an unforeseen way, it has been found that it is possible, simply by a judicious choice of constituents of the mixture and their content in the latter, to form by means of reactive spraying of this mixture a coherent refractory mass which exhibits excellent compatibility with the prefabricated elements used and the original masonry of the wall to be repaired, whether in terms of thermal expansion, refractoriness or chemical behavior.

In addition, according to the invention, although the refractory mass thus deposited by reactive spraying on the prefabricated elements may have a different chemical nature from that of these elements, said refractory mass constitutes a very good interface with these elements.

Advantageously, the aforementioned refractory lining securing the prefabricated elements in the wall to be repaired is obtained by spraying, with the aid of an oxygen-rich carrier gas, a mixture comprising a granular fraction of oxide-based inert refractory particles such as: $SiO_2$, $Al_2O_3$, $ZrO_2$, MgO, $Cr_2O_3$, $TiO_2$, CaO, in various mineralogical varieties and/or associated forms, according to the technological interest, a pulverulent fraction composed of oxidizable particles of a metallic nature such as: Al, Si, Mg, Fe, Cr, Zr, Ti and, in certain specific embodiments, as described in international patent application PCT/BE92/00012 by the same holder, chemical substances which, by decomposition, form, with oxides from the oxidizable particles, mixed oxides in such a way as to constitute a bonding phase for the inert refractory particles. The term "chemical substance" should be understood to mean in particular metallic peroxides such as $CaO_2$, $MgO_2$, $BaO_2$, $SrO_2$ or metal salts such as $AlCl_3$, $SiCl_4$, $MgCl_2$.

Refractory materials based on the oxides mentioned should be understood to mean their various mineralogical varieties such as tridymite, cristobalite and silica glass in the case of $SiO_2$ as well as associated form such as zircon $ZrSiO_4$, spinel $MgAl_2O_4$, zirconium stabilized with CaO or with MgO, the solid solution $Al_2O_3$—$Cr_3O_3$ in any proportion, etc., which each present a special technological interest depending on the application envisaged.

When the aforementioned structure, i.e. the original masonry, is essentially made of siliceous refractory, as is generally the case with the walls of coke ovens, use is made of a mixture of oxidizable and refractory particles for reactive spraying which are chosen in such a way as to form a coherent refractory mass which is likewise essentially siliceous.

According to the invention, it has also been found that by choosing the nature and the relative content of the various oxidizable and refractory components of the mixture to form a refractory mass by reactive spraying which, at the working temperature, particularly at 1200° C., exhibits an overall relative expansion difference relative to that of the prefabricated is element of less than 0.5%, and, in particular for repairs or reconstructions covering at least 2 meters, of less than 0.3%, good compatibility is obtained with the prefabricated elements defined above, which makes it possible to achieve perfect adhesion of said mass both to the old masonry of the wall to be repaired and to the prefabricated elements on which it is applied on the heat chamber side.

Bonding between the sprayed refractory coherent mass and the prefabricated elements is further promoted by providing, on the latter, on the heat treatment chamber side, means for achieving mechanical bonding between the latter and the sprayed refractory mass.

Figure 2:
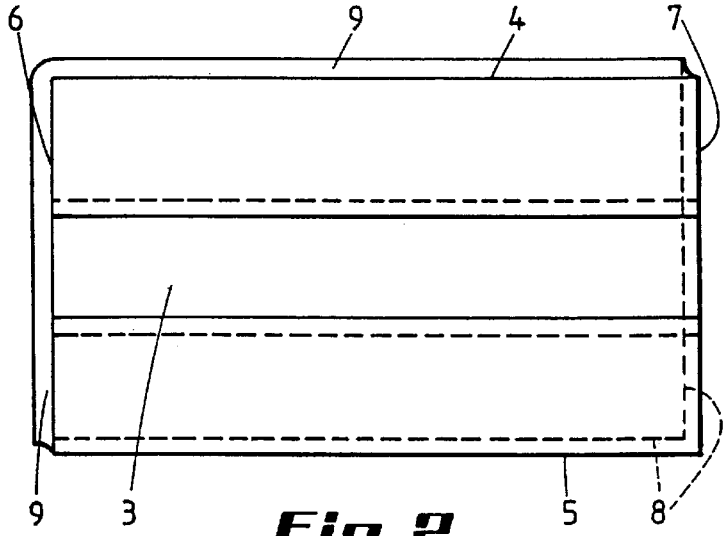
FIG. 2 is a front view of the prefabricated element according to this preferred embodiment.

The prefabricated element according to the invention, as shown in the figures, particularly in FIGS. 1 and 2, is formed of a block of rectangular prismatic form 1 whose face 2 intended to face the heat treatment chamber is fitted with means for achieving, in addition to the ceramic bond obtained by reactive spraying, a mechanical bond with the refractory mass applied to said face 2. In this specific embodiment, these means are formed by a notch 3, e.g. a dovetail notch as illustrated, in the form of a slot extending parallel to the longitudinal edges of said block over the entire length of the latter and more or less in the middle of its face 2.

Figure 3:
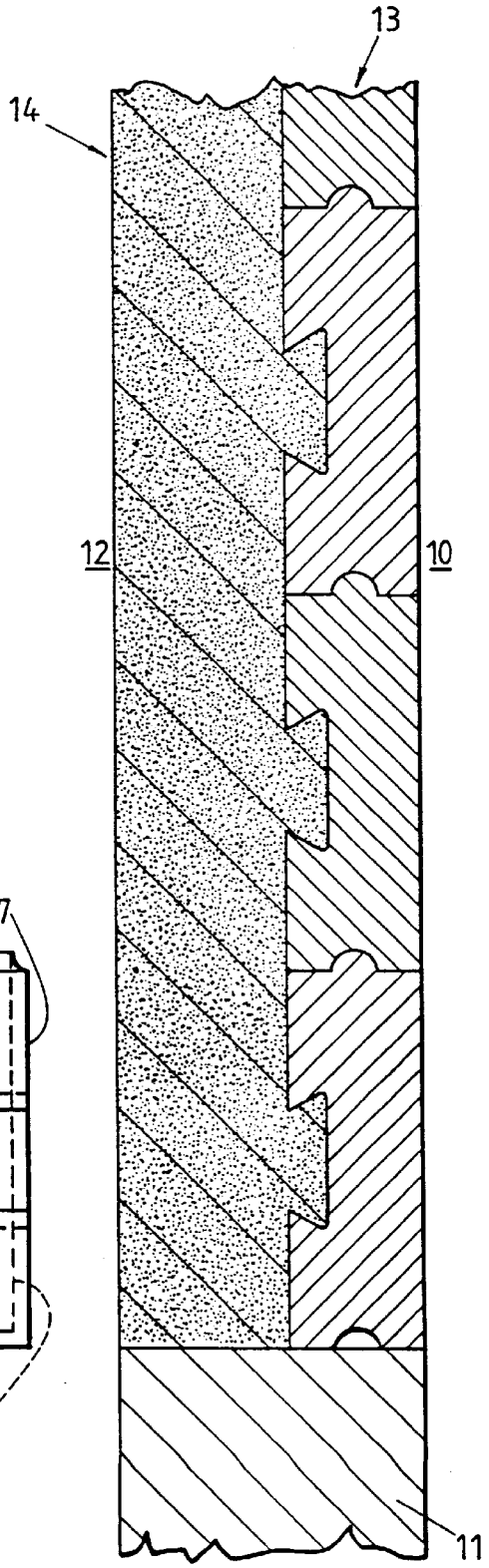
FIG. 3 represents a vertical section of a portion of coke oven wall repaired using the method according to the invention.

In addition, said block advantageously exhibits, at its upper face 4, lower face 5 and lateral faces 6 and 7, corresponding interlocking mans in such a way as to make it is possible to produce a stable and precise dry stack of several blocks 1 on top of each other. As shown in FIGS. 1–3, these interlocking means are: on lower face 5 and later face 7, a groove 8 also extending over the entire length of these faces and, on upper face 4 and capable of engaging in a groove 8 of a superimposed block.

Specific examples of embodiments making it possible to further illustrate the object of the invention are given below.

EXAMPLE 1

This example concerns the repair of a separating wall between the flues and a heat chamber of coke ovens, as shown schematically in the attached FIG. 3.

The damaged zone of the wall to be repaired has first been cleaned in such a way as to free the sound parts of its structure.

The wall to be repaired had a total thickness of 11 cm, while the thickness of bocks 1 was 5 cm.

The repair or reconstruction proper started at the face on the side of flue 10. Prefabricated blocks 1, as shown in FIGS. 1 and 2, having an alumina content of the order of 50%, were placed in the dry state against each other in such a way that the rib of a specific block engaged in the groove of a superimposed adjacent block.

Once the edifice made of mullite blocks had been erected, the junction between the new masonry 13, formed by these blocks 1, and the former masonry 11 of the wall as well as the covering face 2 of the blocks facing heat treatment chamber 12 were produced by reactive spraying in a stream of oxygen containing 13% by weight of Si with a mean diameter of 20 microns, 12% by weight of $CaO_2$ with a mean diameter of 10 microns and 75% of $SiO_2$, taking the form of tridymite and cristobalite with a mean diameter of 300 microns.

This reactive spraying was continued to deposit refractory layer 14 until the total thickness of the repaired zone of the wall exhibited the same thickness as the wall to be repaired.

Thanks to the good resistance to thermal shocks of mullite blocks 1, according to the invention, the latter were able to be brought directly from ambient temperature to the point of installation.

The repaired zone, which restored the profile and the thickness of former masonry 11, was thus composed of masonry 13 of a mullite nature on the side of flue 10 and a siliceous refractory layer 14 formed by reactive spraying, solidly connected to blocks 1 by a ceramic bond and mechanical anchoring in notches 3 on the side of the heat treatment chamber.

Figure 4:
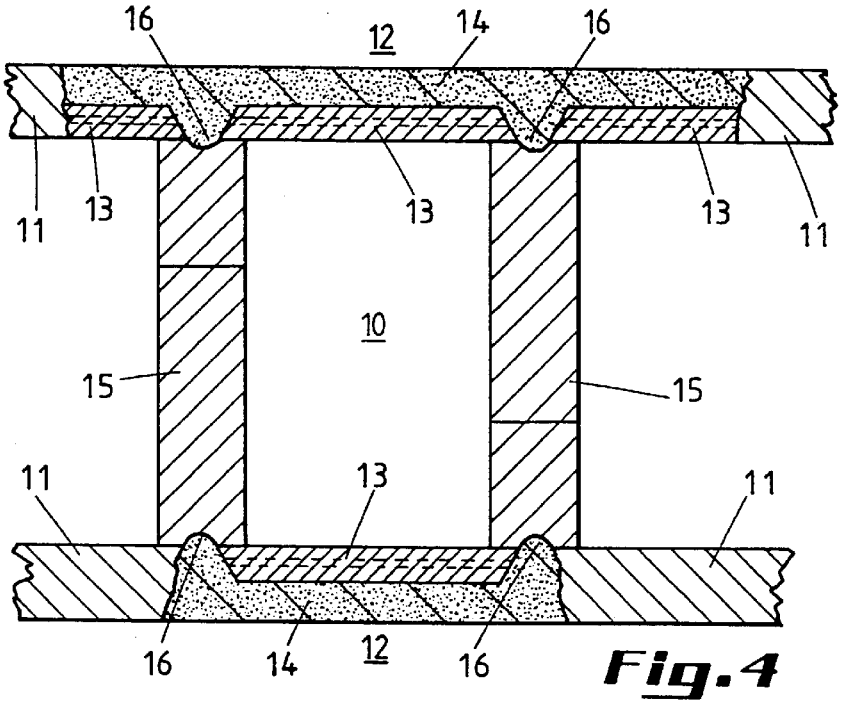
FIG. 4 is a partial horizontal section of a reconstruction of a part of flues according to the method of the invention.

FIG. 4, which is a partial horizontal section, shows a variant of this example 1 and concerns the partial reconstruction of a flue 10.

This variant distinguishes itself somewhat from the example shown in FIG. 3 by virtue of the fact that a bond must be produced between the repaired zone and transverse walls 15 of flue 10.

In order to to this, blocks 1 are cut to the right size and in bevelled shape in such a way as to be able to form, at the point where the transverse walls meet the separating wall with heat treatment chamber 12, a slit 16 with inclined edges in which refractory mass 14 formed by reactive spraying may easily be introduced in order to connect the transverse walls with said separating wall, and in particular to blocks 1 used for the repair of the latter.

EXAMPLE 2

This example concerns above all the repair of large surfaces of a heat-exchange wall between flues and a heat treatment chamber. Both the case illustrated by FIG. 3 and that illustrated by FIG. 4 may thus be involved.

Given that repair block 1, for example for coke ovens, must both withstand thermal shocks during installation and come close, in terms of expansion, to the behavior of original masonry 11 made of silica bricks and to that of refractory layer 14 formed by reactive spraying, indicated above, that a block 1 of mullite nature represents an interesting compromise for meeting these two opposing demands.

However, when the length of the zone to be repaired is considerable (several meters), a variant of the invention consists in using a repair mixture to be sprayed, in which, within the refractory batch, part of the crystallized silica (cristobalite and tridymite) has been replaced by a fraction of vitreous silica whose grain size is 100–500 $\mu$m and preferably 200–400 $\mu$m.

Figure 5:
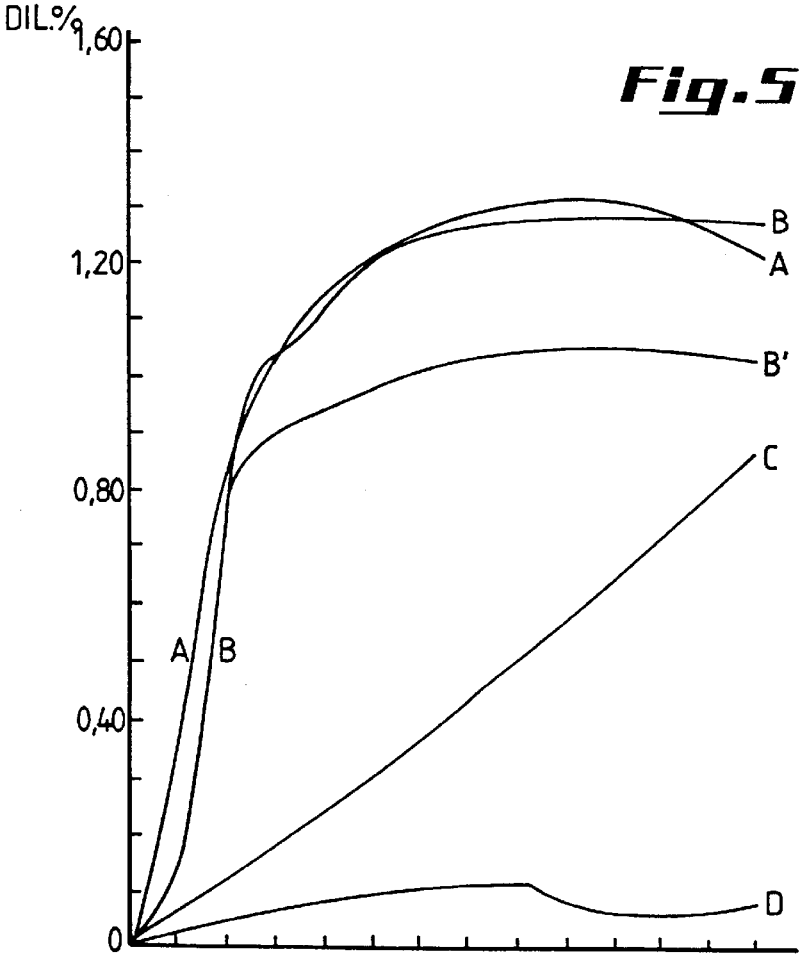
FIG. 5 represents a graph plotting the expansion curve in % as a function of the temperature of various refractory products.

The graph shown in FIG. 5 gives various expansion curves for the products used in the repair and reconstruction at high temperatures of industrial facilities.

Thus, curve A concerns expansion in % as a function of the temperature of a crystalized silica brick, curve B concerns refractory mass 14 obtained by reactive spraying of a mixture according to the formulation given in example 1, curve C is that of mullite block 1, curve D is that of a vitreous glass brick and, finally, curve B' is that of a refractory mass obtained by reactive spraying of a mixture according to the following formulation:

| Components | Weight (%) | Mean Diameter of the Particles ($\mu$m) |
|---|---|---|
| Si | 13 | 20 |
| $CaO_2$ | 12 | 10 |
| Crystalized $SiO_2$ (Tridymite + cristobalite) | 50 | 300 |
| Vitreous $SiO_2$ | 25 | 300 |

This set of expansion curves shows that curves A and B virtually coincide so that it can be expected that the repair of high temperatures of silica bricks, on which a refractory mass obtained from the aforementioned mixture free from vitreous silica is formed, will not present any problem from the expansion point of view.

On the other hand, if curves B and C are considered, it is found that there is a relatively substantial difference between these two curves.

It has, however, been found, according to the invention, and as is also clear from example 1, that despite this difference, in an entirely unforeseen manner, practical tests have shown that there is perfect compatibility between the two products concerned for the conventional repairs and reconstruction envisaged.

If, finally, curve B' is considered, it is found that the addition of vitreous silica to the mixture to be sprayed makes it possible to reduce considerably the difference between curve C of the mullite block and curve B' relating to the sprayed mixture.

Consequently, the benefit of this addition is to reduce mechanical stresses, at the working temperature, which may result from a thermal mismatch relating to a long interface, without this addition having an adverse effect on the mechanical properties of the repaired zone.

It must be understood that the invention is not limited to the special embodiments in the specific examples but that other variants may be envisaged within the scope of the invention, both with regard to the form and the dimensions of the mullite blocks and the means for achieving any mechanical anchoring of sprayed refractory mass 14 on face 2 of these blocks. Thus, the notch in the form of a slot 3 need not, for example, necessarily extend as far as the longitudinal edges of face 2 but could, for example, extend obliquely or perpendicularly relative to these edges. Thus, instead of forming continuous grooves across the entire length of the repaired surface, notches 3 in the assembled blocks could form broken grooves.

The same applies to the mixture of particles which are intended to form, via reactive spraying, refractory mass 14 on face 2 of blocks 1, which could vary within broad limits.

After all, both the chemical and physical nature of the particles incorporated in said mixture and the relative ratios of the quantities of each of the components used in said mixture may vary within relatively broad limits provided that care is taken to prevent said sprayed refractory mass from being able, by chemical reaction, to degrade blocks 1 and prevent the total expansion of said mass and of the blocks at the working temperature from being able to cause the detachment of the refractory mass on blocks 1. The permissible difference between these expansions depends to a large extent on the surface to be repaired. Thus, in the case of relatively limited surfaces, a bigger difference is permitted when the surface to be repaired is relatively large, with it being necessary to ensure that the expansions are as close to each other as possible. Finally, prefabricated element 1 may exhibit a hole, preferably of rectangular section, facilitating handling of the element during its installation.

What is claimed is:

1. A repaired silica refractory structure, comprising a replacement pre-fabricated refractory body located at a repair position of the silica refractory structure, and a coherent refractory mass bonding said pre-fabricated refractory body to the silica refractory structure, said coherent refractory mass comprising an oxidized mixture of particles of exothermically oxidizable material and particles of refractory material wherein said pre-fabricated refractory body comprises a mullite-crystallized refractory body having an alumina content of 30–85%, and said coherent refractory mass is compatible with said mullite-crystallized refractory body and said silica refractory structure, and has a thermal expansion coefficient compatible with the coefficients of thermal expansion of said refractory body and said silica refractory structure, taking into account stresses to which the so-repaired silica refractory structure will be subjected under working conditions.

2. A repaired structure according to claim 1, wherein said coherent refractory mass exhibits an overall relative expansion difference at 1200° C. relative to that of said mullite-crystallized refractory body of less than 0.5%.

3. A repaired structure according to claim 1, wherein said coherent refractory mass exhibits an overall relative expansion difference at 1200° C. relative to that of said mullite-crystallized refractory body of less than 0.3%, and said mullite-crystallized refractory body extends a distance of at least 2 meters.

4. A repaired structure according to claim 1, wherein said mullite-crystallized refractory body has an alumina content of 50–80%.

5. A repaired structure according to claim 1, wherein said mullite-crystallized refractory body has a thickness less than said silica refractory structure, and wherein said mullite-crystallized refractory body is located along an inner wall of said structure.

6. A repaired structure according to claim 1, wherein said mullite-crystallized refractory body has a rectangular prismatic form and is mechanically interlocked with said coherent refractory mass.

7. A repaired structure according to claim 1, wherein said mixture of particles comprises first particles selected from the group consisting of at least one of Al, Si, Mg, Ca, Fe, Cr, Zr, Sr, Ba and Ti, and second particles selected from the group consisting of at least one oxide of said metals, and a compound of at least one of said metals capable by decomposition of forming mixed oxides with oxides of said metals.

8. A repaired structure according to claim 7, wherein said mixture of particles comprises Si.

9. A repaired structure according to claim 8, wherein said second particles comprise silica particles.

10. A repaired structure according to claim 8, wherein said first and second particles comprise at least one peroxide selected from the group consisting of $CaO_2$, $MgO_2$, $BaO_2$ and $SrO_2$, at least one salt selected from the group consisting of $AlCl_3$, $SiCl_4$ and $MgCl_2$, or both a said peroxide and a said salt.

11. A repaired structure according to claim 1, wherein said mixture of particles comprises Si.

12. A repaired structure according to claim 1, wherein said silica refractory structure consists essentially of siliceous refractory material, and said coherent refractory mass also consists essentially of a siliceous refractory material.

13. A repaired structure according to claim 1, wherein said silica refractory structure defines a heat treatment chamber on one side thereof and a flue on an opposite side thereof, and wherein said mullite-crystallized refractory body is placed on said flue side and said coherent refractory mass is located on said heat treatment chamber side.

14. A repaired structure according to claim 1, wherein said coherent refractory mass forms a connecting and sealing joint between said mullite-crystallized refractory body and said silica refractory structure.

15. A repaired structure according to claim 14, wherein said coherent refractory mass comprises a lining covering said mullite-crystallized refractory body.

16. A repaired structure according to claim 15, wherein said mullite-crystallized refractory body is provided with means for achieving a mechanical bonding between said pre-fabricated mullite-crystallized refractory body and said coherent refractory mass applied thereto.

17. A repaired structure according to claim 16, wherein said means for achieving a mechanical bonding comprises at least one notch in the form of a slot.

18. A repaired structure according to claim 1, wherein said mullite-crystallized refractory body comprises a plurality of bricks, said bricks having means for interlocking one brick to an adjacent brick along contact faces therebetween.

19. A repaired structure according to claim 1, wherein said mullite-crystallized refractory body has a thickness which is no greater than one-half the total thickness provided by said mullite-crystallized refractory body and said coherent refractory mass.

* * * * *